US008387955B2

(12) United States Patent
Ptacek et al.

(10) Patent No.: US 8,387,955 B2
(45) Date of Patent: Mar. 5, 2013

(54) INTERLOCKING FENCING SYSTEM

(75) Inventors: James A. Ptacek, Plymouth, MN (US); Steven D. Larson, Zimmerman, MN (US)

(73) Assignee: Highway Technologies, Inc., Oak Brook, IL (US)

( * ) Notice: Subject to any disclaimer, the term of this patent is extended or adjusted under 35 U.S.C. 154(b) by 1049 days.

(21) Appl. No.: 12/196,495

(22) Filed: Aug. 22, 2008

(65) Prior Publication Data

US 2010/0044663 A1 Feb. 25, 2010

(51) Int. Cl.
*E04H 17/16* (2006.01)

(52) U.S. Cl. ..... 256/31; 256/24; 256/65.14; 256/73

(58) Field of Classification Search ..... 256/1, 24–31, 256/56, 65.14, 73; 52/238.1, 239, 582.1; 29/525.01, 428, 897, 897.31, 897.312, 897.32
See application file for complete search history.

(56) References Cited

U.S. PATENT DOCUMENTS

| | | | | | |
|---|---|---|---|---|---|
| 353,130 | A * | 11/1886 | Gholson | 256/1 |
| 2,348,012 | A * | 5/1944 | Levi | 256/25 |
| 3,204,606 | A * | 9/1965 | Parr et al. | 119/514 |
| 4,356,999 | A * | 11/1982 | McShane | 256/26 |
| 4,371,148 | A * | 2/1983 | Harden | 256/26 |
| 4,378,657 | A * | 4/1983 | Romberg | 49/364 |
| 4,567,698 | A * | 2/1986 | Morrison | 52/36.6 |
| 4,625,483 | A * | 12/1986 | Zacky et al. | 52/239 |
| 4,684,108 | A * | 8/1987 | Bergagnini | 256/24 |
| 4,917,543 | A * | 4/1990 | Cole et al. | 405/262 |
| 5,577,710 | A * | 11/1996 | Kirby | 256/24 |
| 5,609,327 | A * | 3/1997 | Amidon | 256/24 |
| 5,649,690 | A * | 7/1997 | Kilmer | 256/35 |
| 6,086,051 | A * | 7/2000 | Wiebe et al. | 256/25 |
| 6,305,672 | B1 * | 10/2001 | Case et al. | 256/65.01 |
| 6,540,209 | B2 * | 4/2003 | Ross | 256/68 |
| 6,554,257 | B1 * | 4/2003 | Kenton | 256/24 |
| 6,578,827 | B2 * | 6/2003 | McCracken | 256/59 |
| 6,789,786 | B1 * | 9/2004 | Schatzberg | 256/25 |
| 6,866,251 | B2 * | 3/2005 | Rosaen | 256/25 |
| 6,964,138 | B2 * | 11/2005 | Carroll et al. | 52/239 |
| 7,186,007 | B1 * | 3/2007 | Rotwitt | 362/287 |
| 7,234,275 | B1 * | 6/2007 | Haggy et al. | 52/71 |
| D552,751 | S * | 10/2007 | Van Buskirk | D25/38 |
| 7,314,212 | B2 * | 1/2008 | Higgins | 256/19 |
| 7,401,576 | B2 * | 7/2008 | Prescott | 119/512 |

* cited by examiner

*Primary Examiner* — Michael P Ferguson
*Assistant Examiner* — Nahid Amiri
(74) *Attorney, Agent, or Firm* — Harness, Dickey & Pierce, P.L.C.

(57) ABSTRACT

A fencing system operable to define a barrier relative to a foundation. The fencing system includes a mount that is operable to be supported by the foundation. The mount includes an upright portion configured to extend from the foundation. The fencing system also includes a first barrier member having a lower bracket that receives the upright portion such that the mount supports the first barrier member generally upright. The fencing system also includes a second barrier member having an upper bracket that receives the upright portion such that the mount supports the second barrier member generally upright and such that the upper bracket substantially overlaps the lower bracket to limit movement of the first barrier member.

11 Claims, 5 Drawing Sheets

INTERLOCKING FENCING SYSTEM

FIELD

The present disclosure relates to a fencing system and, more particularly, relates to an interlocking fencing system.

BACKGROUND

This section provides background information related to the present disclosure which is not necessarily prior art.

Fencing systems provide security and demarcate predetermined areas. Some fencing systems are assembled from a substantially continuous wall portion that is supported upright by a plurality of posts, mounts, etc. Other fencing systems include a plurality of panels that can be installed end-to-end in an upright manner. As such, these fencing systems create a barrier, which can prevent unauthorized persons from entering a secure area or for other similar purposes.

Although prior art fencing systems have functioned for their intended purposes, significant problems still remain. For instance, current fencing systems may not provide a satisfactory level of security. For instance, a person can cut openings through some conventional fencing systems fairly easily. Other fencing systems can be easily disassembled by unauthorized persons in order to pass through the intended barrier.

Moreover, assembly of some fencing systems can be difficult and time consuming. Indeed, some fencing systems require installation of support members, then robust attachment of a wall portion of a plurality of panels to the support members. This assembly process can include various time consuming steps for increasing the strength of the fence. Otherwise, quick assembly of the fence often comes at the expense of security.

SUMMARY

This section provides a general summary of the disclosure, and is not a comprehensive disclosure of its full scope or all of its features.

A fencing system is disclosed that is operable to define a barrier relative to a foundation. The fencing system includes a mount that is operable to be supported by the foundation. The mount includes an upright portion configured to extend from the foundation. The fencing system also includes a first barrier member having a lower bracket that receives the upright portion such that the mount supports the first barrier member generally upright. The fencing system also includes a second barrier member having an upper bracket that receives the upright portion such that the mount supports the second barrier member generally upright and such that the upper bracket substantially overlaps the lower bracket to limit movement of the first barrier member.

In another aspect, a fencing system is disclosed that is operable to define a barrier relative to a foundation. The fencing system includes a plurality of mounts that are operable to be supported by the foundation. The mounts each include an upright portion configured to extend from the foundation. The system also includes a plurality of barrier members each including a lower bracket and an upper bracket and operable to be supported generally upright by the mounts. The barrier members are each operable to be arranged with the respective upper bracket and the respective lower bracket of an adjacent barrier member receiving the upright portion of one of the plurality of mounts. As such, the respective upper bracket substantially overlaps the respective lower bracket of the adjacent barrier member to thereby limit movement of the adjacent barrier member.

In still another aspect, a method of defining a barrier on a foundation with a fencing system is disclosed. The fencing system includes a plurality of mounts and a plurality of barrier members. The mounts each include an upright portion, and the barrier members each include a lower bracket and an upper bracket. The method includes supporting the mounts on the foundation such that the respective upright portions extend from the foundation. The method also includes supporting the plurality of barrier members generally upright with respective ones of the mounts, such that each barrier member is arranged with the respective upper bracket and the respective lower bracket of an adjacent barrier member each receiving the upright portion of one of the plurality of mounts, and such that the respective upper bracket substantially overlaps the respective lower bracket of the adjacent barrier member to thereby limit movement of the adjacent barrier member.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
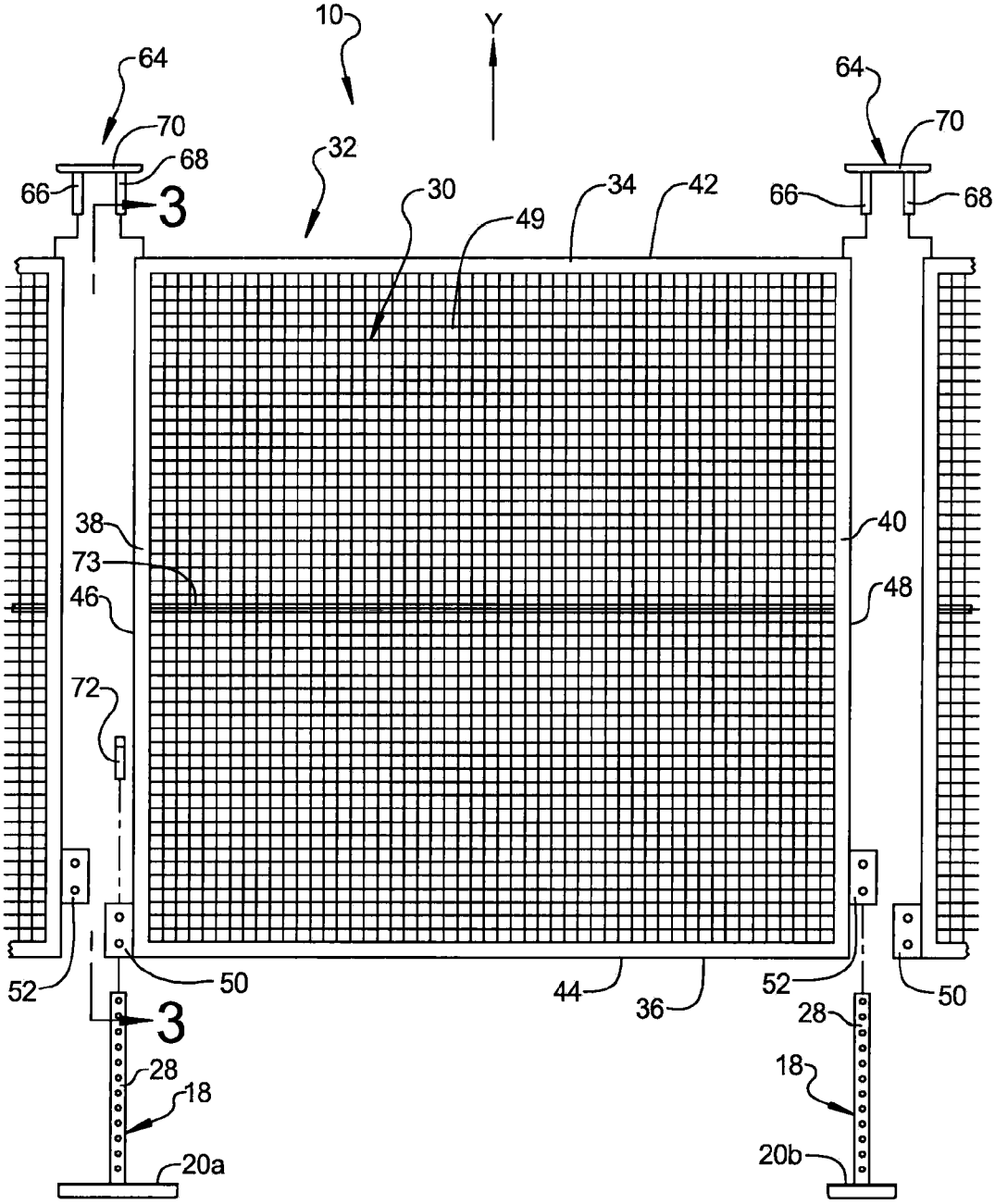
FIG. 1 is a front exploded view of a fencing system according to various embodiments of the present disclosure.
Figure 2:
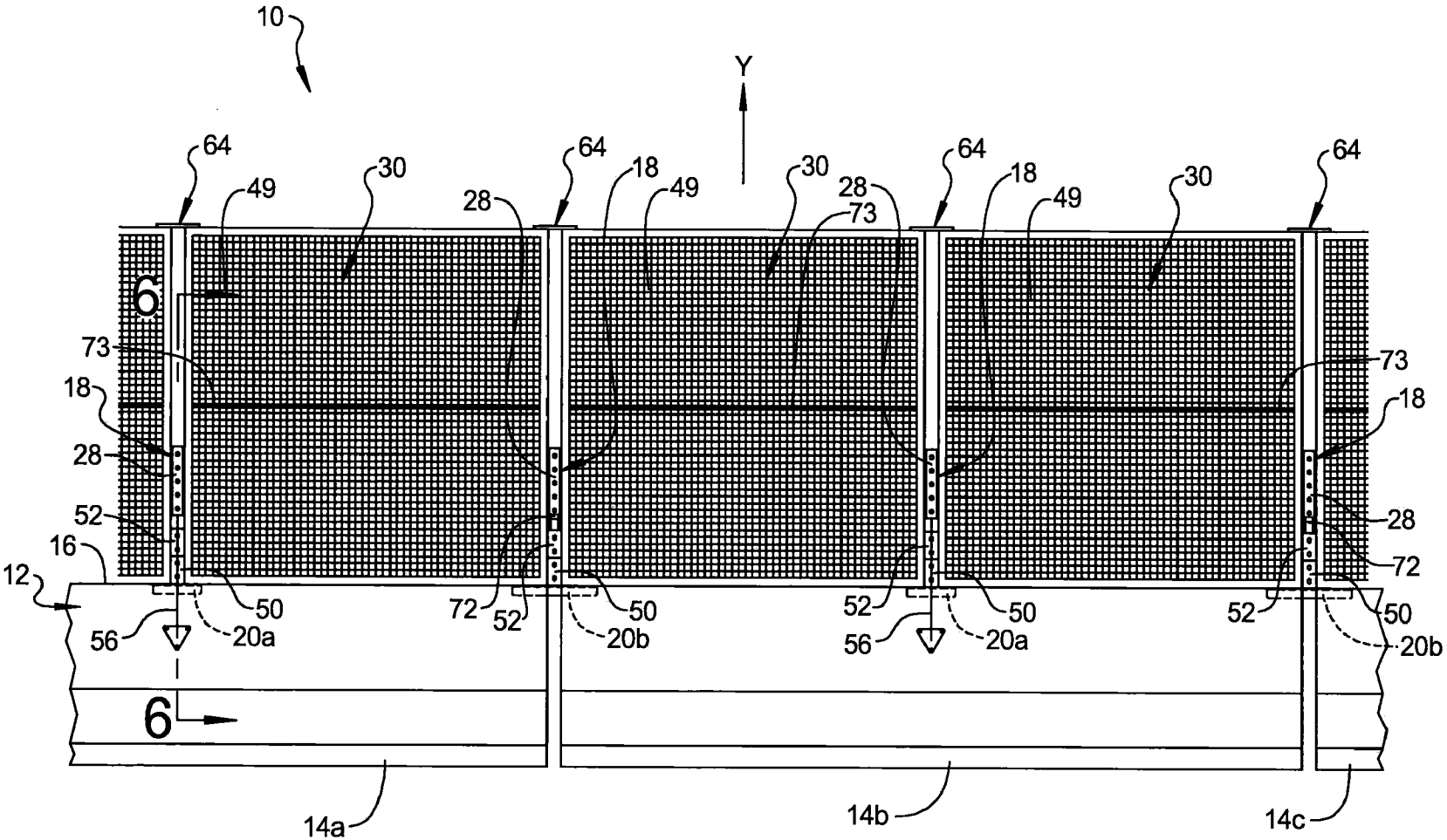
FIG. 2 is a front assembly view of the fencing system of FIG. 1.

Referring initially to FIGS. 1 and 2, a fencing system 10 is illustrated according to various embodiments of the present disclosure. The fencing system 10 defines a barrier relative to a foundation 12. As will be discussed in greater detail, the fencing system 10 can be assembled and disassembled relatively quickly, and yet the fencing system 10 provides a high level of security.

In some embodiments, the foundation 12 includes a plurality of elongate blocks 14*a*, 14*b*, 14*c*. The elongate blocks 14*a*, 14*b*, 14*c* are arranged end-to-end so as to partially define a barrier. In some embodiments, the blocks 14*a*, 14*b*, 14*c* are known cement blocks that interlock in a known manner. More specifically, the blocks 14*a*, 14*b*, 14*c* each include a portion of a ring (not specifically shown) that extends from each respective end and a pin (not specifically shown) that is inserted between adjacent pairs of rings to interlock the blocks 14*a*, 14*b*, 14*c*. The foundation 12 collectively defines a top surface 16. In some embodiments, the fencing system 10 is fixed to the foundation 12 and extends generally upright therefrom.

It will be appreciated that the foundation 12 could be of any suitable type and made out of any suitable material. For instance, the foundation 12 could be pavement, grass, soil, or other flat surface. Also, it will be appreciated that the fencing system 10 could be movably supported atop the foundation 12 instead of being fixed to the foundation 12.

The fencing system 10 includes a plurality of mounts 18 (FIGS. 1, 2, 4A, 4B, 6). The mounts 18 include a base 20*a*, 20*b* and an upright portion 28. The upright portion 28 extends generally upright from the respective base 20*a*, 20*b*. The upright portion 28 can be fixed to the base 20*a*, 20*b*, for instance, by welding processes. The mounts 18 can be made out of any suitable material, such as steel.

Figure 4A:
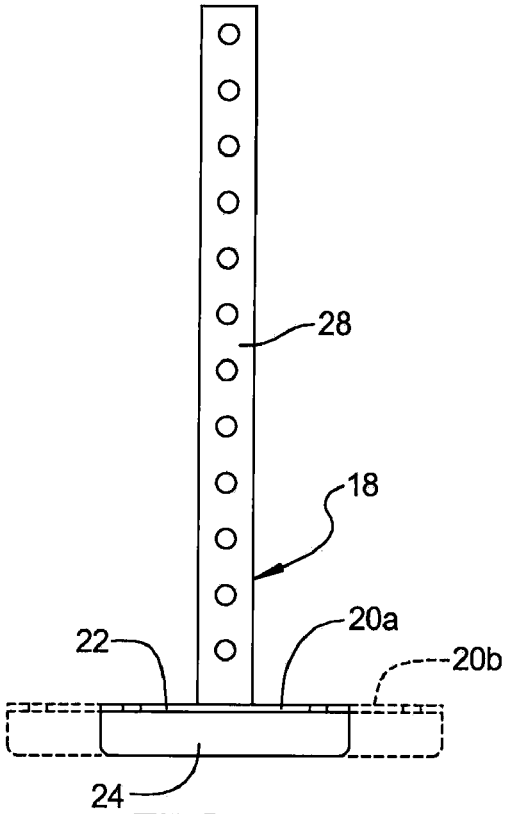
FIG. 4A is a front view of a mount of the fencing system of FIG. 1.
Figure 4B:
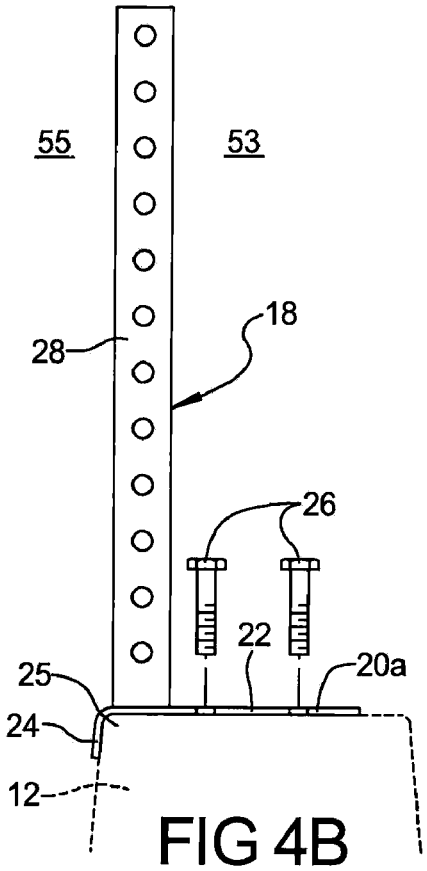
FIG. 4B is a side view of the mount of FIG. 4A.

The base 20*a*, 20*b* is thin and plate-like in shape. The base 20*a*, 20*b* can be made out of sheet metal that is bent adjacent one edge so as to define a plate 22 and a lip 24 (FIGS. 4A, 4B). The mounts 18 are disposed in spaced relationship relative to each other and are supported by the foundation 12. Some of the bases 20*a* are wider so as to extend between and be supported by two adjacent blocks 14*a*, 14*b*, 14*c*. Other bases 20*b* have a reduced width and are supported by a single block 14*a*, 14*b*, 14*c*. Specifically, the plate 22 of the base 20*a*, 20*b* is supported on the top surface 16 of the foundation, and the lip 24 extends over an edge 25 of the foundation 12. In the embodiments illustrated, the base 20*a*, 20*b* can be fixed to the foundation 12 via a plurality of fasteners 26 (FIG. 4B). The fasteners 26 can be of any suitable type, such as masonry bolts. It will be appreciated, however, that the base 20*a*, 20*b* could be movably supported atop the foundation 12, for instance, without departing from the scope of the present disclosure.

Figure 7:
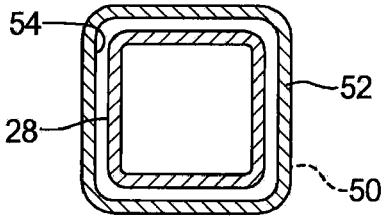
FIG. 7 is a cross sectional view of the fencing system of FIG. 1 taken along the line 7-7 of FIG. 6.

The upright portion 28 can be elongate, tubular, and can be axially straight. Also, in some embodiments, the upright portion 28 can have a rectangular cross section (FIG. 7). In some embodiments, the upright portion 28 can be made out of square cross section, steel posts, generally known as TELSPAR. When the base 20*a*, 20*b* is supported by the foundation 12, the upright portion 28 extends generally upright, away from the foundation 12.

The fencing system 10 further includes a plurality of barrier members 30. In some embodiments, the barrier members 30 are individual panels that can be removably coupled to and supported by respective ones of the mounts 18. The mounts 18 support the barrier members 30 in a generally upright manner as will be described in greater detail.

In some embodiments, each barrier member 30 includes a frame 32 that includes an upper frame portion 34, a lower frame portion 36, a first side frame portion 38, and a second side frame portion 40. Each of the frame portions 34, 36, 38, 40 is elongate, axially straight, and tubular so as to define a rectangular cross section. The frame portions 34, 36, 38, 40 can be made out of any suitable material, such as steel. The frame portions 34, 36, 38, 40 can be arranged and attached, for instance, via welding processes, such that the frame 32 is generally rectangular. Accordingly, the frame 32 defines an upper end 42, a lower end 44, a first side 46, and a second side 48.

The barrier member 30 also includes a wall portion 49. The wall portion 49 can include a plurality of intersecting wires so as to define a mesh-like pattern. The wall portion 49 could alternatively be a solid panel of material. The wall portion 49 can be made of any suitable material, such as steel. In some embodiments, the wall portion 49 is substantially planar; however, the wall portion 49 could have any suitable curvature. The wall portion 49 is fixed to the frame 32, such as via welding processes. As such, the wall portion 49 is substantially encompassed by the frame 32.

Figure 3:
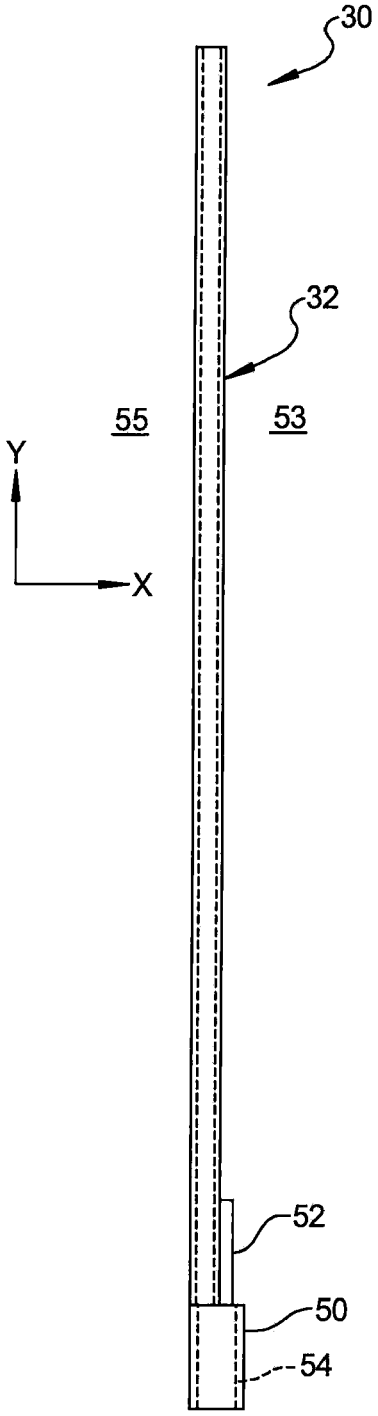
FIG. 3 is a side view of a barrier member of the fencing system of FIG. 1 taken along the line 3-3 of FIG. 1.

The barrier member 30 further includes a lower bracket 50 and an upper bracket 52. Each of the brackets 50, 52 are axially straight and tubular so as to define a rectangular passage 54 therethrough (FIGS. 3, 7). The brackets 50, 52 can be made out of any suitable material, such as steel. In some embodiments, the brackets 50, 52 are made out of TELSPAR. The brackets 50, 52 are fixed (e.g., via welding processes) to opposite sides of the frame 32. More specifically, the lower bracket 50 is fixed to the first side 46 of the frame 32, adjacent the lower end 44, and the upper bracket 52 is fixed to the second side 48 of the frame 32. The brackets 50, 52 are arranged so as to be axially aligned with the side frame portions 38, 40. In other words, the brackets 50, 52 are arranged generally along the upright direction Y (FIG. 1) defined by the barrier members 30. Also, the brackets 50, 52 on each barrier member 30 are disposed in spaced relationship to each other along the upright direction Y (FIG. 1). Furthermore, as shown in FIG. 3, the brackets 50, 52 are wider than the side frame portions 36, 38 and extend partially therefrom in the horizontal direction X.

As will be discussed in greater detail, the brackets 50, 52 can receive a respective upright portion 28 of the mounts 18 such that the respective mount 18 supports the respective barrier members 30 generally upright. As shown in FIG. 7, the interlocking rectangular shapes of the upright portion 28 and the passage 54 inhibit rotation of the brackets 50, 52 relative to the mount 18 for added stability of the fencing system 10.

Furthermore, when the fencing system 10 is assembled, the barrier members 30 are arranged end-to-end with the respective upper bracket 52 of one barrier member 30 and the respective lower bracket 50 of an adjacent barrier member 30 receiving the same upright portion 28 of a mount 18 (FIGS. 1 and 2). As such, the upright portion 28 substantially overlaps the lower bracket 50 of the adjacent barrier member 30. Accordingly, the upright portion 28 limits movement of the adjacent barrier member 30 away from the foundation 12 along the upright direction Y as will be discussed.

To install the fencing system 10, a mount 18 is fixed to the foundation 12 using the fasteners 26. Then, a barrier member 30 is installed on the upright portion 28 of the mount 18 by sliding the respective lower bracket 50 over the mount 18. Next, another barrier member 30 is installed on the same upright portion 28 by sliding the respective upper bracket 52 over the mount 18 so as to overlap the lower bracket 50. This process is repeated along the longitudinal length of fencing system 10 until the plurality of barrier members 30 are similarly interlocked. As such, movement of the barrier member 30 along the upright direction Y away from the foundation 12 is limited because the upper bracket 52 of the adjacent barrier member 30 interferes with such movement. Accordingly, the fencing system 10 provides a high level of security.

Furthermore, the brackets 50, 52 can be installed on the mounts 18 without additional fasteners if so desired. Accordingly, installation can be completed fairly quickly and easily, and yet the fencing system 10 still maintains a high level of security. It will be appreciated, however, that additional fasteners or other attachment devices or methods could be used to additionally secure the brackets 50, 52 to the respective mounts 18 without departing from the scope of the present disclosure.

In addition, in the embodiments illustrated, the barrier members 30 define a first side 53 of the fencing system 10 and a second side 55 of the fencing system 10. As shown in FIG. 4B, each of the fasteners 26 can be disposed on the first side 53 of the fencing system 10 so as to be substantially inaccessible from the second side 55 of the fencing system 10. For example, if a secure area is located on the first side 53 of the fencing system 10, an unauthorized person on the second side 55 would have substantial difficulty removing the fasteners 26 from the second side 55 because of the location of the fasteners 26. Similarly, the brackets 50, 52 extend from the respective side frame portion 38, 40 partially toward the first side 53 (see FIG. 3) to inhibit unauthorized persons from moving the barrier members 30 relative to the mounts 18. Thus, the fencing system 10 provides a high level of security due to the location of the fasteners 26 and brackets 50, 52.

Figure 6:
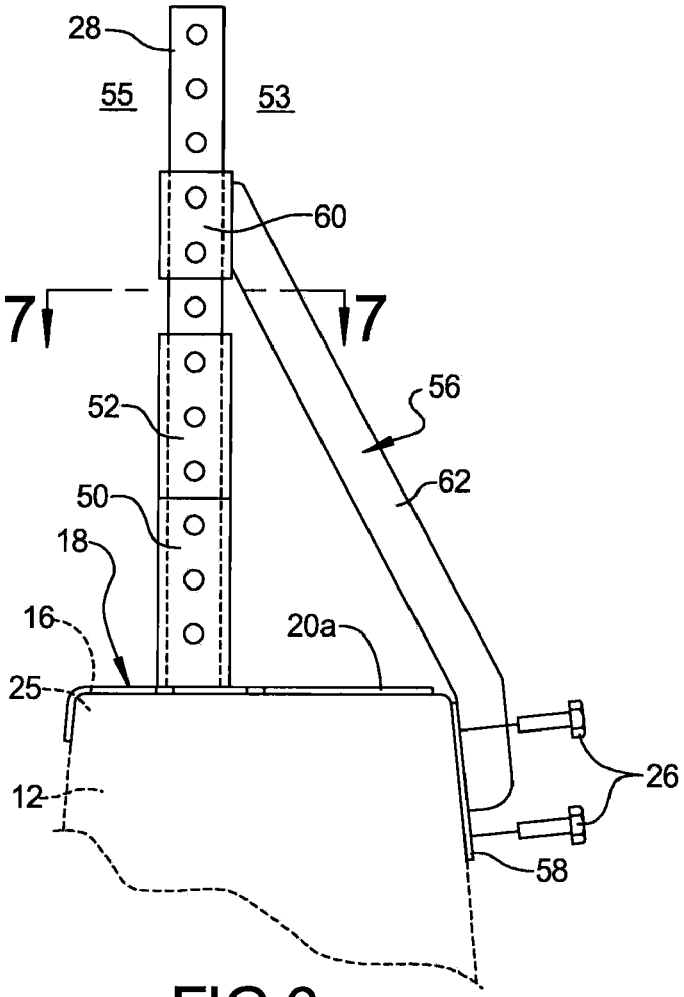
FIG. 6 is a side view of the fencing system of FIG. 1 taken along the line 6-6 of FIG. 1.

Moreover, in some embodiments, the fencing system 10 includes a plurality of features that add stability. For instance, as shown in FIGS. 2 and 6, the fencing system 10 can include a brace 56 having a fixing portion 58, a coupling portion 60, and an elongate intermediate portion 62 that couples the fixing and coupling portions 58, 60. The fixing portion 58 can be flat and plate-like, and the coupling portion 60 can be tubular with a rectangular cross section. The intermediate portion 62 can be elongate, flat, and plate-like, can have a T-shaped cross section, or can have any other suitable shape. The brace 56 can be made out of any suitable material, such as welded steel. The fixing portion 58 can be fixed to the foundation 12 on the first side 53 of the fencing system 10 using fasteners 26, such as masonry bolts. Also, the coupling portion 60 receives the upright portion 28 so as to overlap the brackets 50, 52. As shown in FIG. 2, the braces 56 can be installed on every other mount 18 along the longitudinal length of the fencing system 10, for instance, in the middle of the respective cement block 14*a*, 14*b*, 14*c*. Accordingly, the braces 56 add additional support to the respective mount 18, and the braces 56 also limit movement of the barrier members 30 away from the foundation 12 because the coupling portion 60 overlaps the brackets 50, 52.

Figure 5:
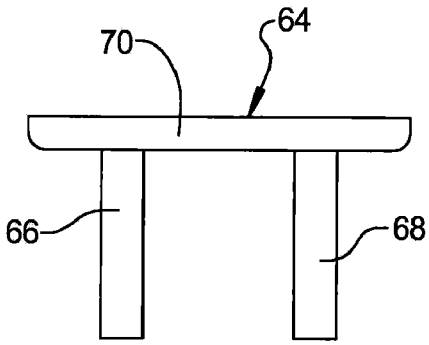
FIG. 5 is a front view of a connector of the fencing system of FIG. 1.

Furthermore, the fencing system 10 can include a plurality of connectors 64 (FIGS. 1, 2, 5) that couple the upper end 42 of one barrier member 30 to the upper end 42 of an adjacent barrier member 30. In some embodiments, the connectors 64 include a first coupling portion 66, a second coupling portion 68, and an intermediate portion 70. The first and second coupling portions 66, 68 extend substantially perpendicular from the intermediate portion 70 and are disposed in spaced relationship relative to each other. The connectors 64 can be made out of any suitable material, such as welded steel. As installed, the first coupling portion 66 is received by a second side frame portion 40 of one barrier member 30, and the second coupling portion 68 is received by a first side frame portion 38 of an adjacent barrier member 30 (see FIGS. 1 and 2). Accordingly, the connectors 64 further secure the barrier members 30 together for added security.

Still further, the fencing system 10 can include a plurality of inserts 72 (FIGS. 1 and 2). The inserts 72 can be elongate and can be made out of any suitable material, such as steel. The insert 72 can be removably inserted between the upright portion 28 of a mount 18 and at least one of the upper and lower brackets 50, 52. In some embodiments, one end of the insert 72 is angled with respect to the other end to act as a handle for inserting and removing the insert 72. In the embodiments illustrated, the insert 72 is wedged between the upright portion 28 and the upper bracket 52. Thus, the insert 72 reduces open space between the upright portion 28 and upper bracket 52 and adds additional support to the respective barrier member 30.

Moreover, the fencing system 10 can include a cross bar 73. The cross bar 73 can be an elongate member made out of any suitable material, such as steel. The cross bar 73 can be fixed to the side frame portions 38, 40 and/or the wall portion 49 of a respective barrier member 30 so as to span horizontally across the width thereof. In some embodiments, the cross bar 73 is welded to the other portions of the barrier member 30. Accordingly, the cross bar 73 can add additional strength and support to the respective barrier member 30 for added security.

Figure 8:
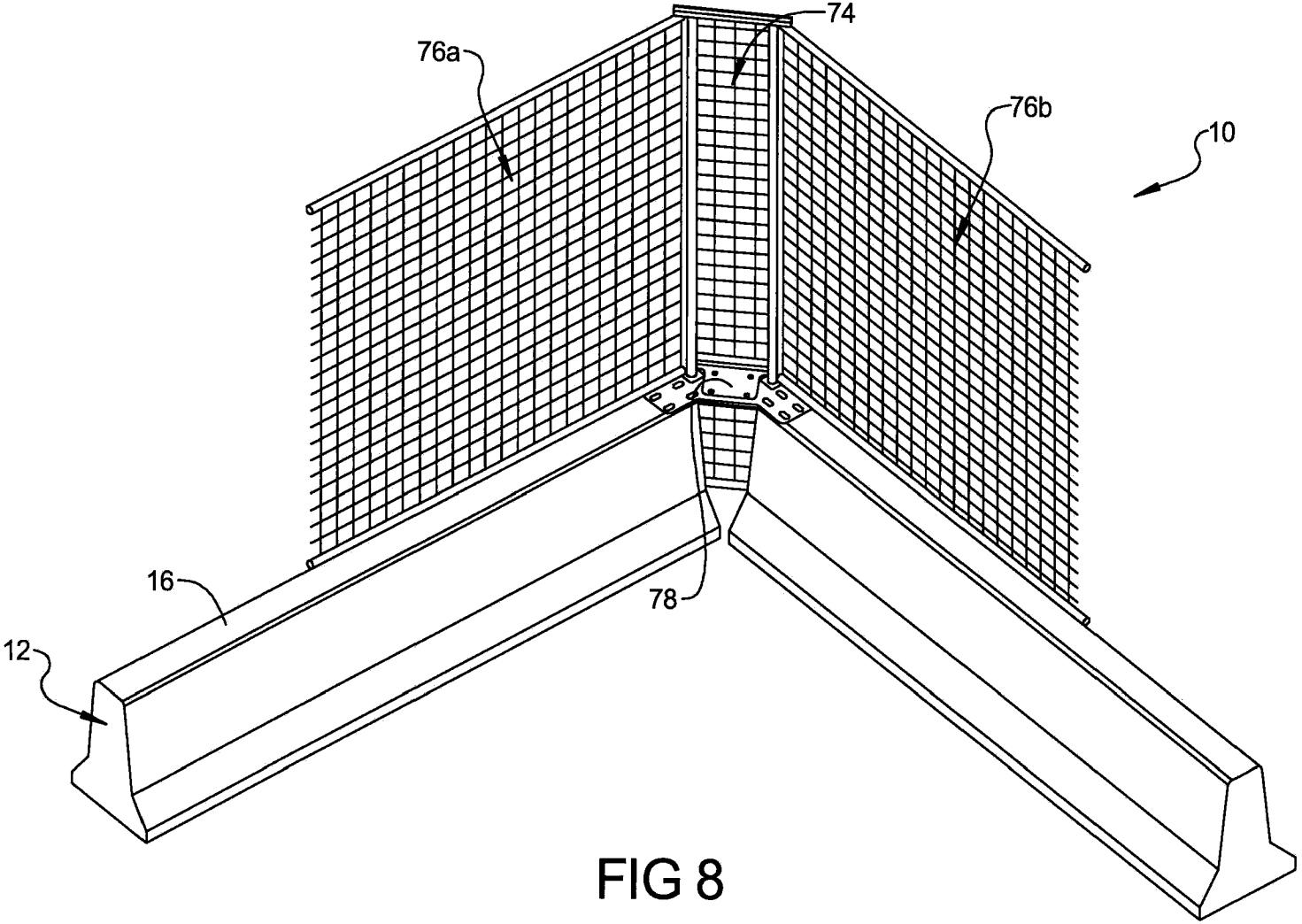
FIG. 8 is a perspective view of a corner member of the fencing system of FIG. 1.

Referring now to FIG. 8, the fencing system 10 is further illustrated. As shown, the fencing system 10 can include a corner member 74. The corner member 74 can be similar to the barrier members 30 so as to include a similar frame 32 and wall portion 49. In some embodiments, the corner member 74 extends to approximately the same height as the barrier members 30, and the corner member 74 also extends below the foundation 12 so as to substantially cover any opening between the respective blocks. The corner member 74 can also include a coupling plate 78 that extends horizontally. Thus, in order to define a corner of the fencing system 10, two barrier members 30 (i.e., end members 76*a*, 76*b* of the fencing system 10) are arranged generally transverse and in spaced relationship to each other. Then, the coupling plate 78 of the corner member 74 is fixedly attached to the ends of the blocks of the foundation 12 on the top surface 16 thereof. The corner member 74 can be fixedly attached to the foundation 12 in any suitable manner, such as fasteners 26. Also, connectors 64 similar to those discussed above can be used to couple the corner member 74 to adjacent barrier members 30. Accordingly, the fencing system 10 is adaptable and can be used to enclose a wide variety of areas of different shapes.

In summary, the fencing system 10 can be assembled and disassembled fairly quickly and easily. However, the fencing system 10 is very robust and can provide a high level of security.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A fencing system comprising:

a mount including an upright portion extending upward from a base;

a first barrier member including a first tubular frame member, the first tubular frame member having a lower bracket along a vertical side member of the first tubular frame member that receives the upright portion such that the mount supports the first barrier member generally upright;

a second barrier member including a second tubular frame member, the second tubular frame member having an upper bracket along a vertical side member of the second tubular frame member that receives the upright portion such that the mount supports the second barrier member generally upright and such that the upper bracket substantially overlaps the lower bracket to limit movement of the first barrier member;

a connector that couples an upper end of the first barrier member and an upper end of the second barrier member, the connector including a first coupling portion that is received within an upper opening of the vertical side member of the first tubular frame member, the connector also including a second coupling portion that is received within an upper opening of the vertical side member of the second tubular frame member; and an insert member that is operable to be removably inserted between the upright portion and one of the upper and lower brackets to thereby support the first and second barrier members generally upright and to reduce an open space between the one of the upper and lower brackets and the upright portion, wherein the upper bracket and the lower bracket each define a passage with a substantially rectangular cross section, and wherein the upright portion has a substantially rectangular cross section.

2. The fencing system of claim 1, wherein the upper bracket and the lower bracket are each tubular and the upright portion is elongate.

3. The fencing system of claim 1, wherein the first barrier member and second barrier member cooperate to define a first side of the fencing system and a second side of the fencing system, wherein the mount is fixed to a foundation by a plurality of fasteners, and wherein the plurality of fasteners are disposed on the first side of the fencing system so as to be substantially inaccessible from the second side of the fencing system.

4. The fencing system of claim 1, wherein the lower bracket, the upper bracket, and the upright portion are each axially straight.

5. The fencing system of claim 4, wherein the first and second barrier members collectively define an upward direction, wherein the upright portion extends generally parallel to the upward direction, and wherein the upper and lower brackets each extend generally parallel to the upward direction.

6. The fencing system of claim 1, wherein at least one of the first and second barrier members include a wall portion that is substantially encompassed by one of the first and second tubular frame members.

7. The fencing system of claim 6, wherein the wall portion includes a plurality of intersecting wires.

8. The fencing system of claim 1, further comprising a brace with a fixing portion that is operable to fix to a foundation and a coupling portion that receives the upright portion to support the upright portion.

9. A fencing system comprising:

a mount including a base and an upright portion extending upward from the base;

first and second barrier members each including a tubular frame member, each tubular frame member having first and second ends, a lower bracket disposed on the first end along a first vertical side member of the tubular frame member, and an upper bracket disposed on the second end along a second vertical side member of the tubular frame member, the first end of the first barrier member and the second end of the second barrier member being adjacent each other such that the lower bracket of the first barrier member and the upper bracket of the second barrier member receive the upright portion of the mount, the upper bracket of the second barrier member substantially overlapping the lower bracket of the first barrier member to thereby limit movement of the first barrier member;

a connector that couples an upper end of the first barrier member and an upper end of the second barrier member, the connector including first and second coupling portions each received within an upper opening of a respective one of the first vertical side member of the first barrier member and the second vertical side member of the second barrier member, respectively;

an insert member that is operable to be removably inserted between the upright portion and one of the upper and lower brackets to thereby support the first and second barrier members generally upright and to reduce an open space between the one of the upper and lower brackets and the upright portion; and a brace that is attachable to a foundation and receives the upright portion to reinforce the fencing system, wherein the first and second barrier members cooperate to define a first side and a second side of the fencing system, wherein the mount is fixed to the foundation by a plurality of fasteners, and wherein the plurality of fasteners are disposed on the first side of the fencing system so as to be substantially inaccessible from the second side of the fencing system, and wherein the upper bracket and the lower bracket each define a passage with a substantially rectangular cross section, and wherein the upright portion has a substantially rectangular cross section.

10. The fencing system of claim 9, wherein the first and second barrier members collectively define an upright direction, and wherein for each of the first and second barrier members, the respective upper and lower brackets are disposed in spaced relationship to each other along the upright direction.

11. The fencing system of claim 9, further comprising a corner member operable to be disposed between a pair of end barrier members that are disposed transverse to each other and that are disposed in spaced relationship to each other, the corner member operable to be fixed to a foundation and to define a barrier between the pair of end barrier members.

* * * * *